US011939840B2

(12) United States Patent
Newton

(10) Patent No.: US 11,939,840 B2
(45) Date of Patent: Mar. 26, 2024

(54) SWELLABLE METALLIC MATERIAL LOCKING OF TUBULAR COMPONENTS

(71) Applicant: Halliburton Energy Services, Inc., Houston, TX (US)

(72) Inventor: Daniel Newton, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/719,292

(22) Filed: Apr. 12, 2022

(65) Prior Publication Data

US 2023/0323754 A1 Oct. 12, 2023

(51) Int. Cl.
*E21B 34/14* (2006.01)

(52) U.S. Cl.
CPC ..... *E21B 34/14* (2013.01)

(58) Field of Classification Search
CPC ..... E21B 34/14; E21B 34/103; E21B 43/108; E21B 2200/06
See application file for complete search history.

(56) References Cited

U.S. PATENT DOCUMENTS

| | | | |
|---|---|---|---|
| 7,066,251 | B2 | 6/2006 | Streater et al. |
| 8,505,638 | B2 | 8/2013 | Ezell et al. |
| 9,816,329 | B2 | 11/2017 | Varghese et al. |
| 10,513,891 | B2 | 12/2019 | Daigle et al. |
| 11,047,203 | B2 | 6/2021 | Fripp et al. |
| 2011/0214883 | A1 | 9/2011 | Patel |
| 2016/0010411 | A1 | 1/2016 | Al-Rabeh |
| 2016/0251933 | A1 | 9/2016 | Gharesi et al. |
| 2019/0264528 | A1 | 8/2019 | Al-Abduljabbar et al. |
| 2021/0270103 | A1* | 9/2021 | Greci ..... E21B 31/007 |

FOREIGN PATENT DOCUMENTS

| | | |
|---|---|---|
| GB | 0612605 | 6/2006 |
| GB | 2439399 | 12/2007 |
| WO | 2012005926 A2 | 1/2012 |

OTHER PUBLICATIONS

International Search Report and Written Opinion for International Patent Application No. PCT/US2022/025598 dated Jan. 4, 2023. PDF file. 7 pages.

* cited by examiner

*Primary Examiner* — Dany E Akakpo
(74) *Attorney, Agent, or Firm* — Scott Richardson; C. Tumey Law Group PLLC

(57) ABSTRACT

A swellable metallic material is activated upon functional movement of a tubular member to lock the tubular member in place. In one example, a well tool includes a tubular member moveable within a through bore of a tool housing from a first position to a second position to perform a tool function. A swellable metallic material is captured in a cavity. The tubular member blocks flow to the cavity in the first position and opens the cavity for exposure of the swellable metallic material to an activation fluid in the second position. The swellable metallic material is configured to swell into engagement with the tubular member in response to the exposure to the activation fluid to hold the tubular member in the second position.

15 Claims, 7 Drawing Sheets

SWELLABLE METALLIC MATERIAL LOCKING OF TUBULAR COMPONENTS

BACKGROUND

A variety of tools are used in the construction, operation, and servicing of a hydrocarbon recovery well. Such tools are alternatively referred to as downhole tools or well tools because they are used in a well deep below the earth's surface. A well tool may be exposed to harsh wellbore conditions characterized, for example, by high temperatures, high forces, and a variety of potentially caustic or reactive wellbore fluids. A well tool also typically needs to be controllable and perform reliably at depths of hundreds or thousands of feet below the earth's surface. These factors present various challenges to designing, building, and operating tools.

Well tools often use some sort of moveable component, such as an inner sleeve, to perform a function. Traditional methods of locking an internal component after it has moved through its functional movement is by means of a snap ring and/or collet. These methods have mechanical limitations on locking force due to the nature of their design and the available bearing area. Any limitations on locking force may result in the internal component of the well tool moving at a time during the life of the well that it is not designed to, such as during intervention operations.

BRIEF DESCRIPTION OF THE DRAWINGS

These drawings illustrate certain aspects of some of the embodiments of the present disclosure and should not be used to limit or define the method.

FIG. 7 is a side view of the lower sleeve member with a porous material disposed in the flow port for the activation fluid to flow through.

DETAILED DESCRIPTION

Figure 1:
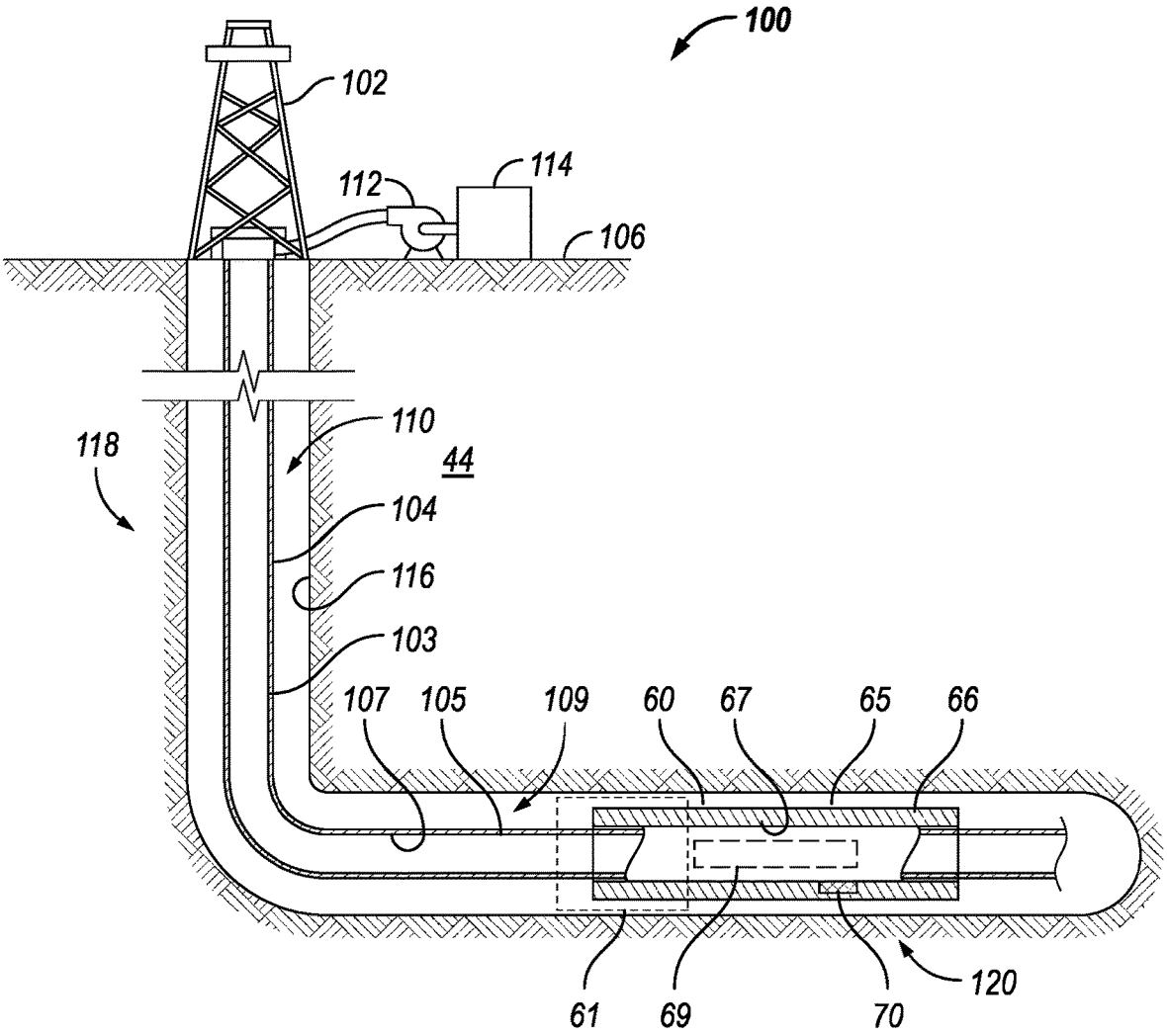
FIG. 1 is a schematic, elevation view of a well site in which a well tool is deployed for construction and operating a hydrocarbon well.

Aspects of this disclosure are directed to using a swellable metallic material to lock a tubular member in position after the tubular member has moved through its functional movement. In this respect, an element that uses the swellable metallic material to lock a member (e.g., the tubular member) in position may be referred to herein as a locking element. This can be used in any of a variety of downhole applications, including but not limited to sliding inner sleeves, swivels, quick unions, or any assembly including a moving tubular component that must be locked in place after its function has completed. One example disclosed is a well tool with an internal tubular component. The internal tubular component may be moveable within a housing to perform some tool function, such as to lock components together, to provide hydraulic fluid actuation (e.g., via a piston), or to open and/or close flow ports. Movement of the internal tubular component to its final position exposes the metal alloy to an activation fluid. Another example is a downhole tubular assembly wherein a swellable metallic material is exposed in response to bringing tubular members into connection. The activation fluid reacts with the swellable metallic material to swell into locking engagement with another component to mechanically lock the tubular member in place. This may allow the well tool or tubular assembly to exceed the mechanical specification on locking force that might otherwise be limited due to available bearing area or part design.

In one example, a well tool has an internal tubular component moveable with respect to another component, which may be the housing. The internal tubular component may be axially and/or rotationally moved to perform a function such as to close a port. A swellable metallic material is carried on one of the tubular components and is initially isolated to prevent activation fluid from contacting the swellable metallic material. A flow path is initially blocked but may be open to allow activation fluid to reach the metal alloy once the internal moving component is moved. This flow path could be a tortuous flow path, flow around the exposed edges of the component (e.g., leak path), an open port or slot, a flow path covered by sintered beads, mesh or other variation of a porous medium that would allow free fluid flow to the metal alloy. Once the internal moving component is moved, the flow path allows activation fluid to contact the swellable metallic material. The activation fluid generates a reaction with the swellable metallic material forming a final product that expands and generates a physical lock between the stationary component of the well tool and the moving component.

A swellable metallic material according to this disclosure may be any material that sufficiently expands in response to contact with an activation fluid to secure one tubular member with respect to another tubular member. The swellable metallic material may expand in one or more dimensions, depending on geometry and space constraints. In one or more examples, the swellable metallic material may be arranged radially outwardly of the flow path and expand radially inwardly to close the flow path when activated.

Although various materials may expand to some extent in contact with a fluid, few if any such materials have the requisite material properties to lock a tubular member with respect to another tubular member, and to then maintain that locking and withstand the caustic and extreme environment of a well tool. The category of swellable metallic materials that may be particularly chosen for use with the disclosure are swellable metallic materials. The activation fluid for swellable metallic materials may comprise a brine. The swellable metallic materials are a specific class of metallic materials that may comprise metals and metal alloys and may swell by the formation of metal hydroxides. The swellable metallic materials swell by undergoing metal hydration reactions in the presence of brines to form metal hydroxides.

In one example, the swellable metallic material may be placed in proximity to a selected flow path and then activated by the brine to cause, induce, or otherwise participate in the reaction that causes the material to expand to lock tubular members together. Activation causes the swellable metallic material to increase its volume, become displaced, solidify, thicken, harden, or a combination thereof. The swellable metallic materials may swell in high-salinity and/or high-temperature environments where elastomeric materials, such as rubber, can perform poorly.

In one or more embodiments, the metal hydroxide occupies more space than the base metal reactant. This expansion in volume allows the swellable metallic material to form a lock at the interface of the swellable metallic material and any adjacent surfaces. For example, a mole of magnesium has a molar mass of 24 g/mol and a density of 1.74 g/cm3 which results in a volume of 13.8 cm/mol. Magnesium hydroxide has a molar mass of 60 g/mol and a density of 2.34 g/cm3 which results in a volume of 25.6 cm/mol. 25.6 cm/mol is 85% more volume than 13.8 cm/mol. As another example, a mole of calcium has a molar mass of 40 g/mol and a density of 1.54 g/cm3 which results in a volume of 26.0 cm/mol. Calcium hydroxide has a molar mass of 76 g/mol and a density of 2.21 g/cm3 which results in a volume of 34.4 cm/mol. 34.4 cm/mol is 32% more volume than 26.0 cm/mol. As yet another example, a mole of aluminum has a molar mass of 27 g/mol and a density of 2.7 g/cm3 which results in a volume of 10.0 cm/mol. Aluminum hydroxide has a molar mass of 63 g/mol and a density of 2.42 g/cm3 which results in a volume of 26 cm/mol. 26 cm/mol is 160% more volume than 10 cm/mol. The swellable metallic material comprises any metal or metal alloy that may undergo a hydration reaction to form a metal hydroxide of greater volume than the base metal or metal alloy reactant. The metal may become separate particles during the hydration reaction and these separate particles lock or bond together to form what is considered as a swellable metallic material.

Examples of suitable metals for the swellable metallic material include, but are not limited to, magnesium, calcium, aluminum, tin, zinc, beryllium, barium, manganese, or any combination thereof. Preferred metals include magnesium, calcium, and aluminum. Examples of suitable metal alloys for the swellable metallic material include, but are not limited to, any alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these nonmetallic elements include, but are not limited to, graphite, carbon, silicon, boron nitride, and the like. In some examples, the metal is alloyed to increase reactivity and/or to control the formation of oxides. In some examples, the metal alloy is also alloyed with a dopant metal that promotes corrosion or inhibits passivation and thus increased hydroxide formation. Examples of dopant metals include, but are not limited to nickel, iron, copper, carbon, titanium, gallium, mercury, cobalt, iridium, gold, palladium, or any combination thereof. In examples where the swellable metallic material comprises a metal alloy, the metal alloy may be produced from a solid solution process or a powder metallurgical process. The locking element comprising the metal alloy may be formed either from the metal alloy production process or through subsequent processing of the metal alloy. As used herein, the term "solid solution" may include an alloy that is formed from a single melt where all of the components in the alloy (e.g., a magnesium alloy) are melted together in a casting. The casting can be subsequently extruded, wrought, hipped, or worked to form the desired shape for the locking element having the swellable metallic material. Preferably, the alloying components are uniformly distributed throughout the metal alloy, although intragranular inclusions may be present, without departing from the scope of the present disclosure.

It is to be understood that some minor variations in the distribution of the alloying particles can occur, but it is preferred that the distribution is such that a homogenous solid solution of the metal alloy is produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase. A powder metallurgy process generally comprises obtaining or producing a fusible alloy matrix in a powdered form. The powdered fusible alloy matrix is then placed in a mold or blended with at least one other type of particle and then placed into a mold. Pressure is applied to the mold to compact the powder particles together, fusing them to form a solid material which may be used as the swellable metallic material.

In some alternative examples, the swellable metallic material comprises an oxide. As an example, calcium oxide reacts with water in an energetic reaction to produce calcium hydroxide. 1 mole of calcium oxide occupies 9.5 $cm^3$ whereas 1 mole of calcium hydroxide occupies 34.4 $cm^3$ which is a 260% volumetric expansion. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof.

A swellable metallic material may be selected that does not degrade into the brine. As such, the use of metals or metal alloys for the swellable metallic material that form relatively water-insoluble hydration products may be preferred. For example, magnesium hydroxide and calcium hydroxide have low solubility in water. In some examples, the metal hydration reaction may comprise an intermediate step where the metal hydroxides are small particles. When confined, these small particles may lock together. Thus, there may be an intermediate step where the swellable metallic material forms a series of fine particles between the steps of being solid metal and forming a lock. The small particles have a maximum dimension less than 0.1 inch and generally have a maximum dimension less than 0.01 inches. In some embodiments, the small particles comprise between one and 100 grains (metallurgical grains).

In some alternative examples, the swellable metallic material is dispersed into a binder material. The binder may be degradable or non-degradable. In some examples, the binder may be hydrolytically degradable. The binder may be swellable or non-swellable. If the binder is swellable, the binder may be oil-swellable, water-swellable, or oil- and water-swellable. In some examples, the binder may be porous. In some alternative examples, the binder may not be porous. General examples of the binder include, but are not limited to, rubbers, plastics, and elastomers. Specific examples of the binder may include, but are not limited to, polyvinyl alcohol, polylactic acid, polyurethane, polyglycolic acid, nitrile rubber, isoprene rubber, PTFE, silicone, fluoroelastomers, ethylene-based rubber, and PEEK. In some embodiments, the dispersed swellable metallic material may be cuttings obtained from a machining process.

In some examples, the metal hydroxide formed from the swellable metallic material may be dehydrated under sufficient swelling pressure. For example, if the metal hydroxide resists movement from additional hydroxide formation, elevated pressure may be created which may dehydrate the metal hydroxide. This dehydration may result in the formation of the metal oxide from the swellable metallic material. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the swellable metallic material may allow the swellable metallic material to form additional metal hydroxide and continue to swell.

FIG. 1 is a schematic, elevation view of a well site 100 for construction and operating a well 110 for recovery of hydrocarbons such as oil and gas from an underground formation 44. Features of the well site 100 and well 110 are schematically indicated and not to scale. The well 110 includes a wellbore 116 drilled into the formation 44. The wellbore 116 includes a vertical wellbore section 118 extending down to a lateral wellbore section 120. A large support structure generally indicated at 102 may be used for lowering, raising, and supporting equipment in the well 110. The support structure may include, for example, a derrick, a lifting mechanism such as a hoist or crane, and other equipment. The equipment of the support structure 102 may be used for supporting a conveyance, which in this example is a tubing string 104, extending from a surface 106 of the well site 100 into the well 110 drilled in the formation 44. Other suitable conveyances may include, for example, wireline or coiled tubing, depending on the particular application.

The tubing string 104 may represent any of a variety of tubing strings used in oil and gas industry including but not limited to a drill string used in drilling the well 110, a completion string used in completing the well 110 in preparation for production, a production tubing string used to control production of formation fluids, or a work string for servicing the well at any stage of the well's construction and service life. The tubing string 104 includes tubing 103 that may be used to support various tools along the tubing string 104. The tubing 103 may comprise tubing segments or strands coupled end to end, or longer, continuous tubing such as coiled tubing.

An example well tool 60 is supported on the tubing string 104. The well tool 60 is schematically drawn and may represent any of a variety of tools used to construct or service the well. Service operations may involve, for example, the delivery of a well fluid or other materials through the tubing string 104 and to or through the well tool 60. In this example, the well tool 60 is deployed in the lateral section 120 of the well 110 but could alternatively be deployed anywhere along the wellbore 116.

Tubular structures may be used throughout the tubing string 104, with some tubular components interfacing with other tubular components. For example, the tubing 103 of the tubing string 104 includes an outer surface that may be generally referred to as the outer diameter (OD) 105 of the tubing 103 and an inner surface that may be generally referred to as the inner diameter (ID) 107 of the tubing 103. The ID 107 of the tubing 103 may define an internal flow path generally aligned with the wellbore 116 for conveyance of fluids along the wellbore 116. An external flow path may also be provided by an annulus 109 defined between the OD 15 of the tubing 103 and open-hole or casing-lined portions of the wellbore 116.

The well tool 60 may also comprise tubular structures for performing tool functions and for connection with the tubing string 104. For example, the well tool 60 may include a tubular housing 66 with an OD 65 and an inner wall defining an ID 67. The ID 67 at a connector portion 61 (uphole and/or downhole ends) of the well tool 60 may receive and conform to the OD 105 of the tubing 103. An example of such a sliding tubular connection is a polished bore receptacle (PBR). A sliding tubular connection may be secured with a connector or latching mechanism. The tool housing includes an axially-extending through bore defined by the inner wall (e.g., ID 67) that allows flow through the tool 60 between an uphole end and downhole end. The term "bore" in the context of a well tool through bore does not limit the housing 66 or the through bore to being formed from any particular method (e.g., boring), and those features may be formed by any suitable method including but not limited to extruding, forging, stamping, bending, or otherwise.

One or more functional tubular structure schematically indicated at 69 may also be provided in or on the well tool 60. A functional tubular member is configured for a functional movement with respect to another component. Examples of functional tubular structures include a moveable inner sleeve or piston. For instance, an inner sleeve inside the tool housing 66 may be operated to perform a tool function such as locking or unlocking one tool component with respect to the other, opening or closing ports in the tool, or to operate any of a variety of piston-actuated mechanisms useful with well tools, as non-limiting examples.

As further discussed below, a tubular member may be moveable within the through bore of the housing (e.g., along the ID 67) from one (i.e., a first) position to another (i.e., a second) position to perform a tool function. A swellable metallic material 70 may be disposed in a cavity in the inner wall 67. A tubular member may block flow (e.g., of the activation fluid) to the wall cavity in the first position and open the wall cavity in the second position for exposure of the swellable metallic material to the activation fluid. The swellable metallic material 70 is configured to swell into engagement with a tubular member in response to the exposure to the activation fluid to hold the tubular member in the second position. More particularly, the swelling of the swellable metallic material may lock one tubular component with respect to another, as detailed in examples below.

A pump 112 is provided at the surface 106 of the well site 100 for pumping fluid from a fluid source 114 downhole through the tubing string 104 to the well tool 60. The pump 112 may be used to pump a well fluid such as drilling fluid (mud), casing cement, a stimulation fluid, or other fluid that would be flowed through the well tool 60 during a service operation. The fluid source 114 may also include a separation activation fluid pumped downhole after completion of the service operation to activate a swellable metallic material and close a flow path of the well tool 60 according to the disclosure. Although a single pump and fluid source are illustrated in this schematic drawing, different fluids used to service the well in different service operations, and the activation fluid may be kept in separate vessels and/or pumped separately and at different times, optionally using different pumps for different fluids and tasks. Although an onshore well site is depicted, aspects of this disclosure may alternatively be used in offshore applications.

Figure 2:
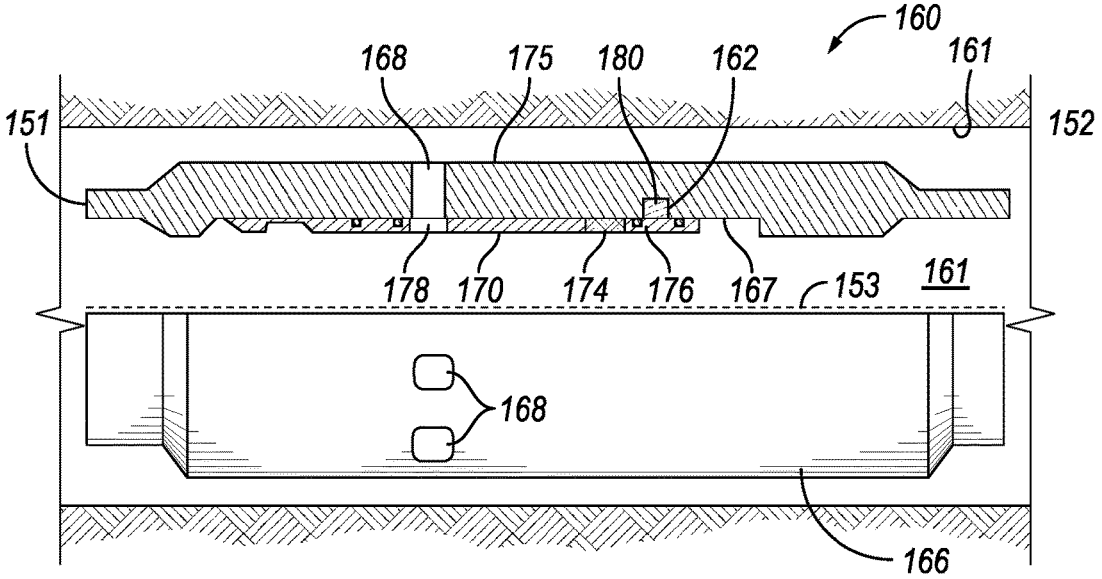
FIG. 2 is a partially sectioned side view of a well tool, as a specific example configuration or variation of the well tool schematically depicted in FIG. 1.

FIG. 2 is a partially sectioned side view of a well tool 160, which may be a specific example configuration or variation of the well tool 60 schematically depicted in FIG. 1. The well tool 160 includes a tool housing 166 with an uphole end 151, a downhole end 152, and an axially-extending through bore 161 between the uphole end 151 and downhole end 152. A central axis 153 may be generally aligned with the axis of the wellbore 116 in which the well tool 160 may be disposed. A length of the well tool 160 may be defined in an axial direction. The through bore 161 may be bounded by an inner wall 167 defining an ID. The inner wall 167 may have a diameter that varies in an axial direction. At least a portion of the inner wall 167 may have a constant diameter for slidingly receiving a tubular member, such as a tubular tool component of the well tool 160, or a tubing or other tool to be connected to the well tool 160. In this example, the tubular member is a tubular tool component comprising an inner sleeve 170 moveably disposed within the housing 166. The inner sleeve 170 is axially moveable with respect to the housing 166 but may be additionally or alternatively moveable in a rotational direction with respect to the housing 166 about the axis 153. The inner sleeve is a unitary structure in this example, but could alternately comprise a plurality of interconnectable and/or separable inner sleeve portions as further described herein.

The inner wall 167 of the housing 166 defines a wall cavity 162 open to the through bore 161 of the housing 166 (subject to being closed by the inner sleeve 170). A swellable metallic material 180 is positioned in the wall cavity 162. In FIG. 1, the swellable metallic material 180 is flush with the inner wall 167, such that the swellable metallic material 180 does not appreciably protrude into the through bore 161 or otherwise does not prevent movement of the inner sleeve 170 with respect to the housing 166. The inner sleeve 170 in FIG. 1 is in a first position, which in this example is a first axial position. In this first position, the inner sleeve 170 closes the wall cavity 162. Optionally, a sealing element 176 is carried on an outer diameter (OD) 175 of the inner sleeve 170 (and/or on the ID of the housing 166) and seals between the inner wall of the housing 166 and inner wall (ID) 167 of the housing 166 to sealingly close the wall cavity 162 in the first position. Thus, in the first position the inner sleeve 170 may block any appreciable fluid flow (e.g., of an activation fluid) to the swellable metallic material 180. The inner sleeve 170 includes at least one flow port 174 through a wall of the inner sleeve 170 that is offset from the wall cavity 162 in the first position. The flow port 174 is moveable into alignment (i.e. fluid communication, not necessarily centered) with the wall cavity 162 by moving the inner sleeve 170.

In one aspect, as described above, the inner sleeve 170 is therefore operable to close or open the wall cavity 162 or to otherwise block or unblock flow to the wall cavity 162 to selectively expose the swellable metallic material 180 to activation fluid. The inner sleeve 170 may be operable to perform some tool function whereby the functional movement of the inner sleeve 107 also blocks or unblocks flow to the wall cavity 162. For example, in the first position of FIG. 2, another flow port 178 on the inner sleeve 170 is initially aligned (i.e., in fluid communication, not necessarily centered) with a housing flow port 168 to allow fluid flow into or out of the well tool 160. This flow may be of well fluids pumped downhole, formation fluids flowing up through the tubing string, and/or for the activation fluid. A functional movement of the inner sleeve 170 may include closing flow by displacing the flow port 178 on the inner sleeve 170 with respect to the flow port 168 on the housing 166.

Figure 3:
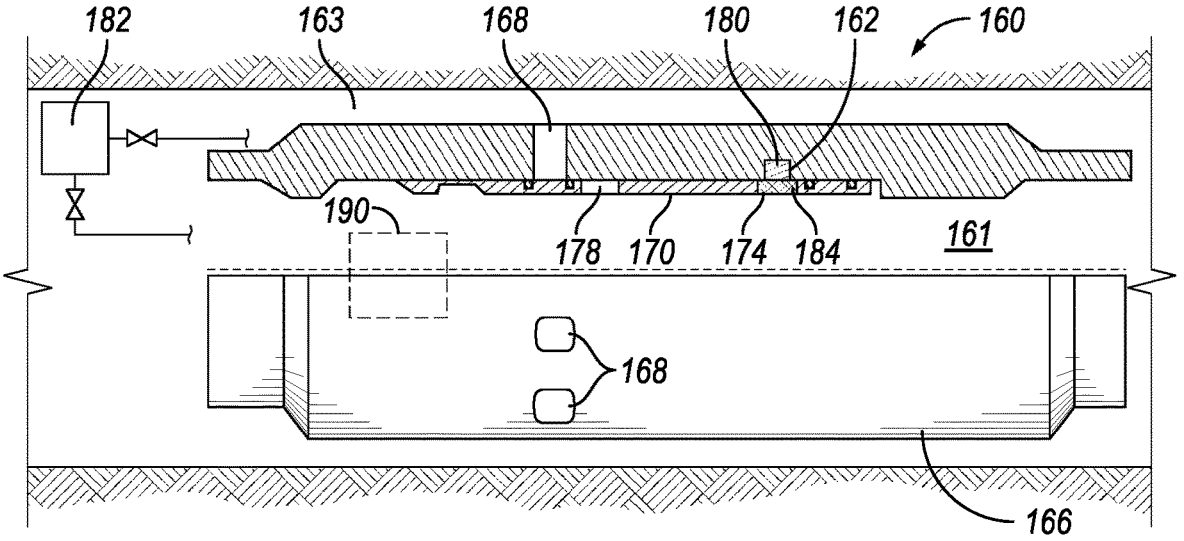
FIG. 3 is another partially sectioned side view of the well tool of FIG. 2 wherein the inner sleeve has been moved axially from the first position of FIG. 2 to a second position.

FIG. 3 is another partially sectioned side view of the well tool 160 of FIG. 2 wherein the inner sleeve 170 has been moved axially from the first position of FIG. 2 to a second position. In the second position the inner sleeve 170 opens the wall cavity 162, which, in this example, is by placing the flow port 174 in fluid communication with the wall cavity 162. The other flow port 178 on the inner sleeve 170 is now offset from and no longer in communication with the flow port 168 on the housing. Thus, in the second position, flow into the well tool 160 through the flow ports 168, 178 has been closed, while flow, e.g., of an activation fluid if/when applied, may enter the cavity 162 for exposure to the swellable metallic material 180.

An activation fluid may be supplied from anywhere along the well site, e.g. from surface pumps (see discussion of FIG. 1) or an activation fluid reservoir in the well tool 160 or anywhere along the well string. An activation fluid source is schematically indicated at 182, which may be fluidically coupled with an annulus 163 about the well tool 160 and/or the through bore 161 of the well tool 160. Flow of activation fluid from the activation fluid source 182 may be controlled and selectively delivered to the swellable metallic material 180. For example, the activation fluid may be pumped downhole through the tubing string and into the through bore 161 when the wall cavity 162 is open. Alternatively, the activation fluid may be pumped downhole through the annulus 163 when the inner sleeve 170 is in the first position (FIG. 2) to enter the through bore 161 via the aligned flow ports 168, 178, so that when the inner sleeve 170 is moved to the second position the activation fluid in the through bore 161 may then enter the wall cavity 162 for exposure to the swellable metallic material 180.

When the swellable metallic material 180 is exposed to the activation fluid, the swellable metallic material 180 will react and expand out of the wall cavity 162 and into the flow port 174. Once the expanded swellable metallic material 180 solidifies and hardens, it interferes with movement of the annular inner sleeve, thereby locking the inner sleeve 170 with respect to the housing 166. in the second position. As illustrated, an optional porous material 184 is positioned in the flow port 174 of the inner sleeve 170. The swellable metallic material 180 in the wall cavity 162 of the tool housing 166 is expandable into pores of the porous material 184 in response to the exposure to the activation fluid.

The inner sleeve 170 may be moved from the first position to the second position as part of its functional movement, using any of a variety of tools and methods. For example, the inner sleeve 170 may be hydraulically driven via a piston or moved via a linear actuator. Alternatively, an optional retrievable actuation tool 190 may be lowered into the wellbore to move the inner sleeve 170.

FIGS. 2 and 3 describe an example of functional movement whereby the inner sleeve 170 is moved axially from the first position to the second position, i.e., that the first and second positions are axially spaced. Alternatively, the functional movement may include a rotational component such that the first and second positions may be circumferentially spaced about the axis 153 of FIG. 2. For example, in such alternate configuration, the inner sleeve 170 may be rotatable to unblock the wall cavity 162. In yet another configuration, the first and second positions may be both axially and circumferentially spaced, so that the first inner sleeve 170 is moved from a first position to a second position by a combination of axial movement and rotational movement.

Figure 4:
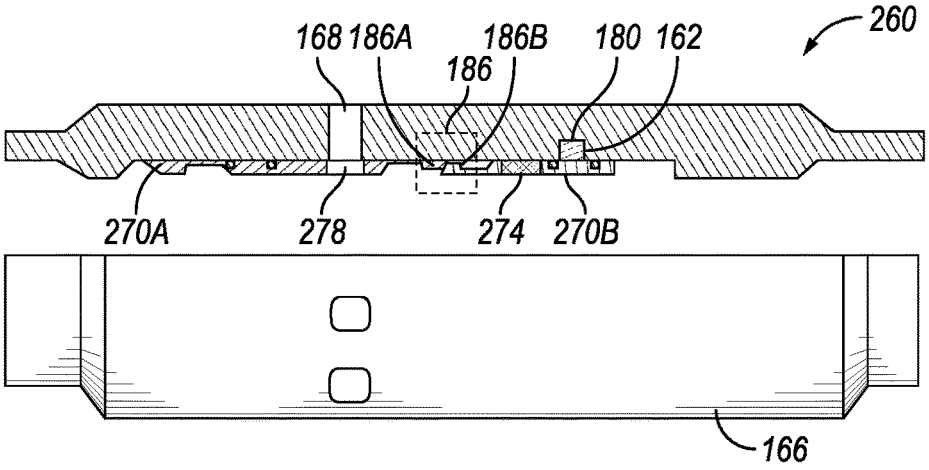
FIG. 4 is a partially sectioned side view of another example configuration of a well tool with an inner sleeve having multiple inner sleeve members.

FIG. 4 is a partially sectioned side view of another example configuration of a well tool 260 with an inner sleeve 270 having multiple sleeve members. Generally, an inner sleeve according to this disclosure may include any number of inner sleeve members wherein adjacent inner sleeve members may be interconnectable and/or releasable. The example of FIG. 4 includes two inner sleeve members, a first (e.g., uphole/upper) inner sleeve member 270A and a second (e.g., downhole/lower) inner sleeve member 270B. The housing 166 may be the same as the housing 166 of FIGS. 2 and 3. A flow port 274 in this embodiment is on the lower inner sleeve member 270B. The flow port 274 is initially offset from the wall cavity 162 and the lower inner sleeve member 270B is axially moveable into alignment (fluid communication) with the wall cavity 162. The other flow port 278 is on the upper inner sleeve member 270A, initially aligned with the flow port 168 on the housing 166.

The upper and lower inner sleeve members 270A, 270B may be independently moveable within the housing 166, at least prior to coupling. The upper inner sleeve member 270A is axially moveable into engagement with the lower inner sleeve member 270B. An inner sleeve coupler 186 includes a coupling member 168A on the upper inner sleeve member 270A configured to couple with a coupling member 168B on the second inner sleeve member 270B in response to moving the first inner sleeve member 270A axially into engagement with the second inner sleeve member 270B. Thus, the upper inner sleeve member 270A may be urged axially into engagement with the lower inner sleeve member 270B, first to couple the upper and lower inner sleeve members 270A, 270B, and further to move the upper and lower inner sleeve members 270A, 270B together to close the flow port 168 and open the wall cavity 162 for exposure of the swellable metallic material 180 to activation fluid.

Figure 5:
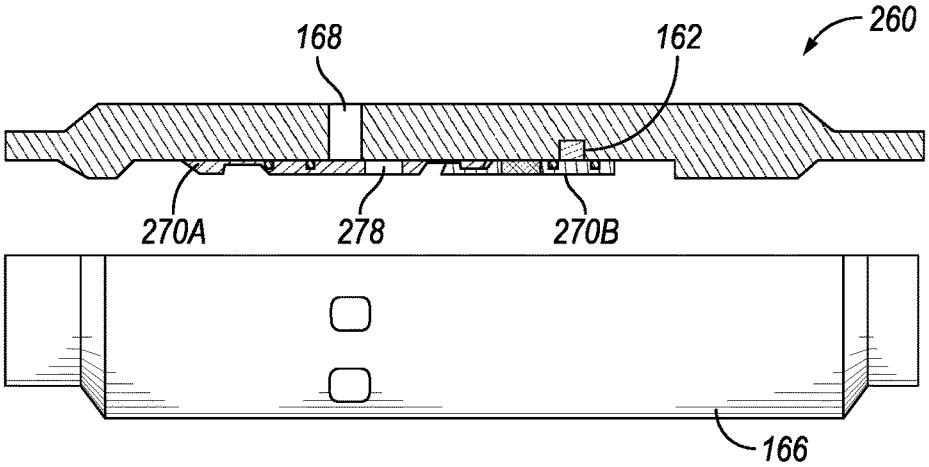
FIG. 5 is another view of the well tool of FIG. 4 wherein the upper sleeve member has been moved to an intermediate position coupled with the lower sleeve member.

FIG. 5 is another view of the well tool 260 of FIG. 4 wherein the upper inner sleeve 270A has been moved from the first position of FIG. 4 to an intermediate position, coupling the upper inner sleeve member 270A with the lower inner sleeve member 270B. The flow port 168 on the housing 166 is now closed by having moved the flow port 278 on the inner sleeve out of alignment with the flow port 168 on the housing 166. However, the lower inner sleeve member 270B is still closing the wall cavity 162.

Figure 6:
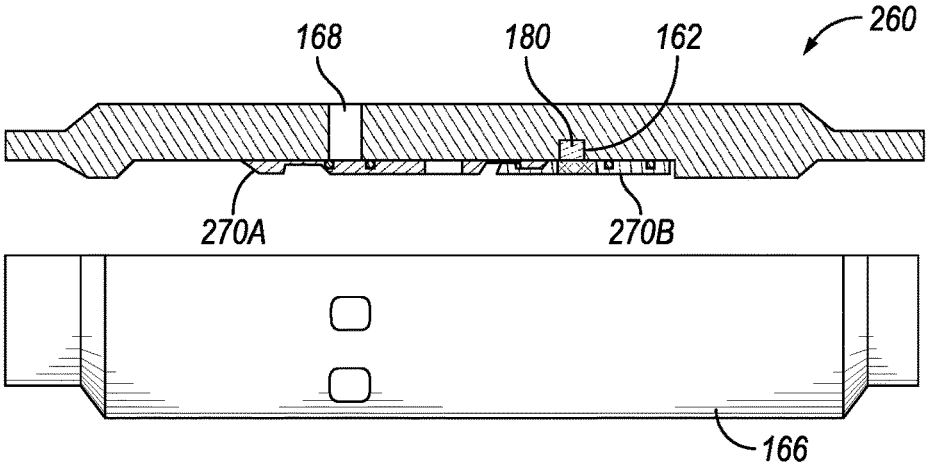
FIG. 6 is another view of the well tool wherein the first and second inner sleeve members have been moved to a second or final position.

FIG. 6 is another view of the well tool 260 wherein the first and second inner sleeve members 270A, 270B have been moved further, beyond the intermediate position of FIG. 5, to a second or final position. The flow port 168 remains closed by the upper inner sleeve member 270A, and the lower inner sleeve member 270B has opened the wall cavity 162 for exposure of the swellable metallic material 180 to an activation fluid.

Figure 7:
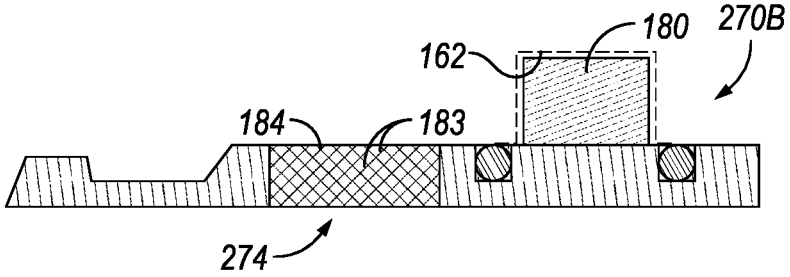
Figure 8:
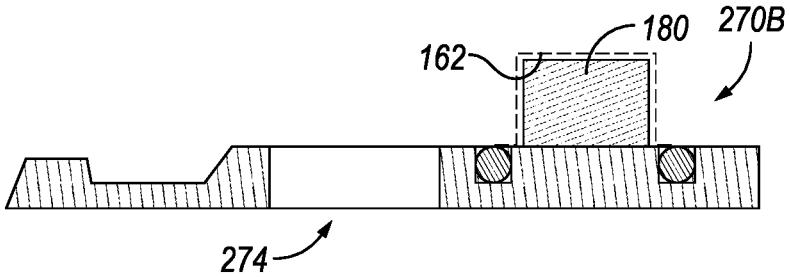
FIG. 8 is a side view of the lower sleeve member of FIG. 7, with no porous material disposed in the flow port.
Figure 9:
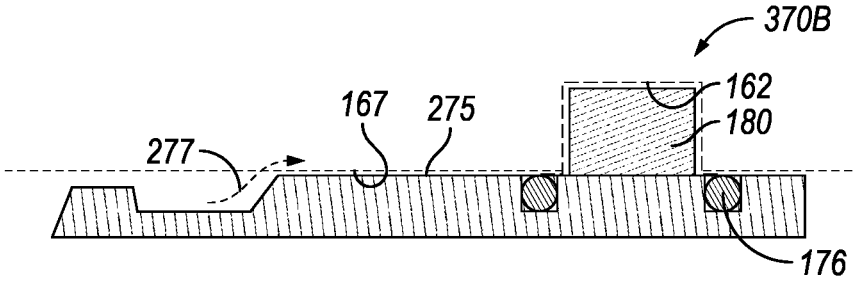
FIG. 9 is a side view of an alternative configuration with a leak path rather than a flow port for the activation fluid.

FIGS. 7-9 provide non-limiting examples of various alternative inner sleeve configurations. These examples are based on the lower inner sleeve member 270B of the two-piece inner sleeve of FIGS. 4 and 6, but the discussion may also apply to corresponding features of the one-piece inner sleeve of FIGS. 2-3.

FIG. 7 is a side view of the lower inner sleeve member 270B as configured in FIGS. 4-6, with a porous material 184 disposed in the flow port 274 on the lower inner sleeve member 270B. The porous material 184 may comprise sintered beads, a mesh, or other variation of a porous medium having a plurality of pores 183 that would allow fluid flow through the flow port 274 and through the porous material 184 disposed therein. The lower inner sleeve member 270B is shown blocking the wall cavity 162 in FIG. 7 but is slideable as discussed above to open the wall cavity 162 and expose the swellable metallic material 180 to flow such as to the activation fluid. The swellable metallic material 180 in the wall cavity 162 of the tool housing would then be expandable into the pores 183 of the porous material 184 in response to the exposure to the activation fluid. The mesh or other porous material 184 may provide a number of benefits. In one aspect, the porous material 184 may help retain the swellable metallic material 180 within the flow port 274 during activation. The porous material 184 may also provide a structure for the swellable metallic material 180 to engage, which may increase the retention and capacity to lock the inner sleeve member 270B in the second position.

FIG. 8 is a side view of the lower inner sleeve member 270B of FIG. 7, with no porous material disposed in the flow port 274 on the lower inner sleeve member 270B. The lower inner sleeve member 270B is shown blocking the wall cavity 162 in FIG. 8 but is slideable as discussed above to open the wall cavity 162 and expose the swellable metallic material 180 to flow such as to the activation fluid. The swellable metallic material 180 in the wall cavity 162 of the tool housing would then be expandable into the flow port 274 in response to the exposure to the activation fluid. The flow port 274 (e.g., dimensions) and the formulation of the swellable metallic material 180 may be selected so as to allow the swellable metallic material 180 to expand into the flow port 274 without appreciably expanding or flowing out the other side of the flow port 274. The flow port 274 itself provides a structure for the swellable metallic material 180 to engage, to retain and lock the inner sleeve member 270B in the second position.

FIG. 9 is a side view of an alternative configuration of a lower inner sleeve member 370B that omits a radial flow port (e.g., omits flow port 274 of FIGS. 4-8). Instead, a flow path (i.e., leak path) 277 is provided between an OD 275 of the lower inner sleeve member 370B and the ID 167 the tool housing. In the position of FIG. 9, the lower inner sleeve member 370B sealingly closes the wall cavity 162 via the sealing element 176. Once the lower inner sleeve member 370B is slid to the second position, moving the sealing element 176 away from the wall cavity 162, the leak path 277 will then extend to the wall cavity 162 for exposure to the swellable metallic material 180.

Figure 10:
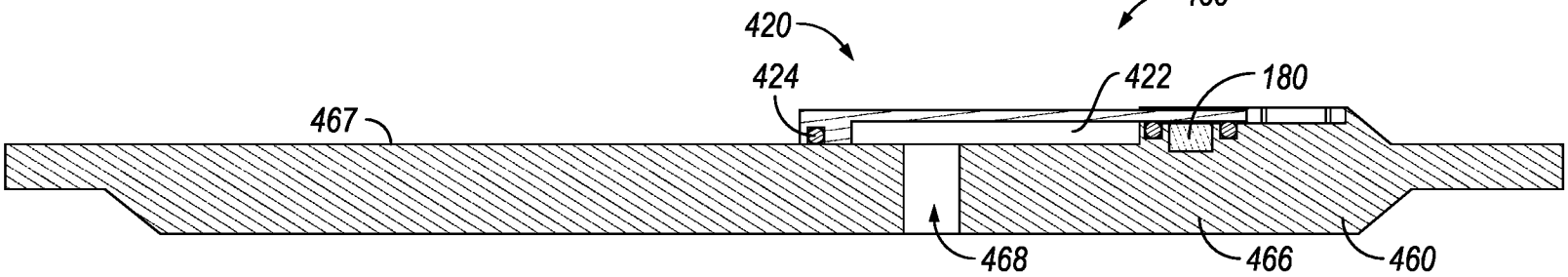
FIG. 10 is another embodiment of a well tool incorporating a hydraulic piston that initially isolates the swellable metallic material.

FIG. 10 is another embodiment of a well tool 460 incorporating a hydraulic piston 420 as the tubular member to isolate the swellable metallic material 180 from activation fluid. In this example, the piston 420 sealingly engages the inner wall 467 of the tool housing. The piston 420 as part of its functional movement is moveable in response to a hydraulic fluid from the first position to the second position. Pressurized hydraulic fluid may be directed through a flow port 468 into a hydraulic chamber 422 defined between the piston 420 and a tool housing 460. The hydraulic fluid may be supplied using any suitable flow control elements and methods. A sealing element 424 seals between the piston 420 and the housing 466. Pressurized hydraulic fluid flowing into the hydraulic chamber 422 may thus urge the piston 420 from a first position of FIG. 10 to a second position of FIG. 11.

Figure 11:
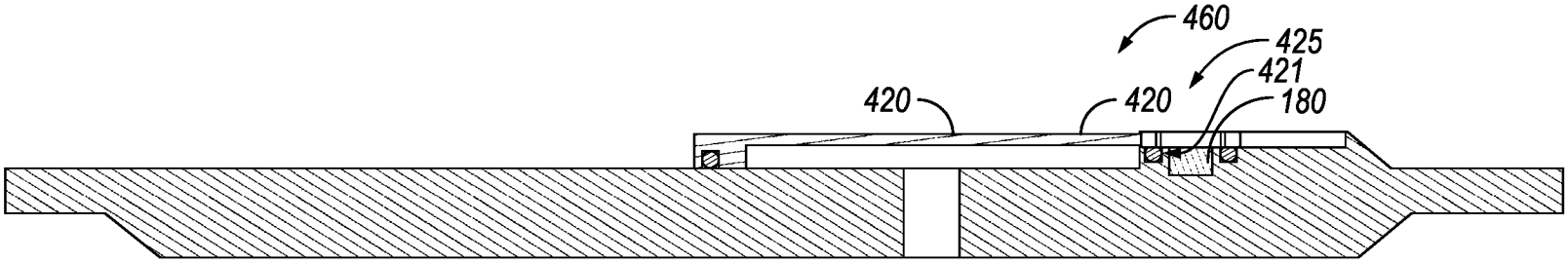
FIG. 11 is another view of the well tool of FIG. 10 after the piston has been urged to a second position exposing the swellable metallic material.

FIG. 11 is another view of the well tool 460 of FIG. 10 after the piston 420 has been urged from the first position of FIG. 10 to a second position. In the second position, an end 421 of the piston 420 may open a flow path 425 to the swellable metallic material 180. Thus, in the example of FIGS. 10 and 11, a tool function performed by the well tool 460 may comprise the actuation of the piston 420 or some other function controlled by actuation of the piston 420. Once the piston 420 has been actuated to move the piston 420 to the second position of FIG. 11, and the swellable metallic material 180 has been activated, the swellable metallic material 180 will swell to lock the piston 420 in this second position.

Figure 12:
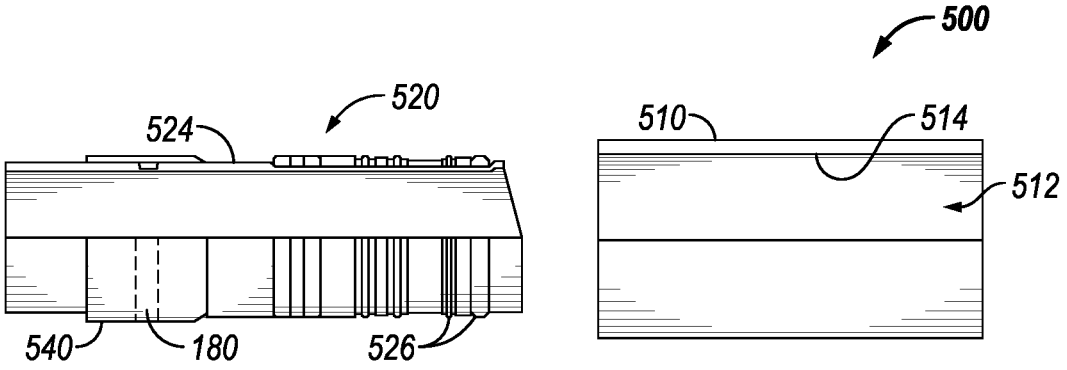
FIG. 12 is a partially sectioned side view of a downhole tubular assembly that uses swellable metallic material to lock tubular members according to another embodiment.

FIG. 12 is a partially sectioned side view of a downhole tubular assembly 500 according to another embodiment. The downhole tubular assembly 500 may comprise a polished bore receptacle (PBR), for instance. The downhole tubular assembly 500 includes an outer tubular member 510 having an axial through bore 512 defined by an inner diameter (ID) 514 of the outer tubular member 510. The downhole tubular assembly 500 also includes an inner tubular member 520 comprising an outer diameter (OD) 524 moveable into the ID 514 of the outer tubular member 510. The tubular members 510, 520 may be moved into connection, wherein the connection is the function and which movement may be regarded as a functional movement of one tubular member with respect to the other. A swellable metallic material 180 is carried on the OD 524 of the inner tubular member 520, but could alternatively be carried on the ID 514 of the outer tubular member 510. A cover 540 is positioned on the inner tubular member initially covering the swellable metallic material 180. The cover 540 may be displaced in response to moving the OD 524 of the inner tubular member 520 into the ID 514 of the outer tubular member 510 to expose the swellable metallic material 180 to an activation fluid. For example, the cover 540 may be sheared off, pierced, slid, or otherwise moved or affected in such a way as to expose the swellable metallic material 180. A sealing element, which may comprise one or a plurality of annular sealing members 526 such as O-rings, may be provided on the OD 524 of the inner tubular member 520 as shown and/or on the ID 514 of the outer tubular member 510.

Figure 13:
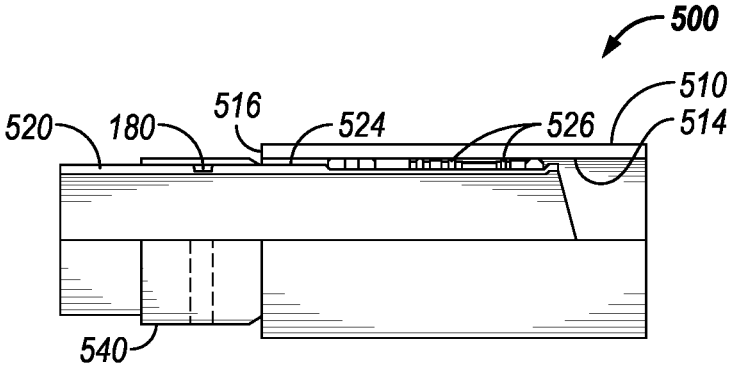
FIG. 13 is another side view of the downhole tubular assembly in which the inner tubular member has been sealingly inserted into the outer tubular member.

FIG. 13 is another side view of the downhole tubular assembly 500 in which a portion of the OD 524 of the inner tubular member 520 has been inserted into the ID 514 of the outer tubular member 510. The annular sealing members 526 seal between the inner tubular member 520 and outer tubular member 510. The cover 540 is now abutting an end 516 of the outer tubular member 510 but is still in place over the swellable metallic material 180.

Figure 14:
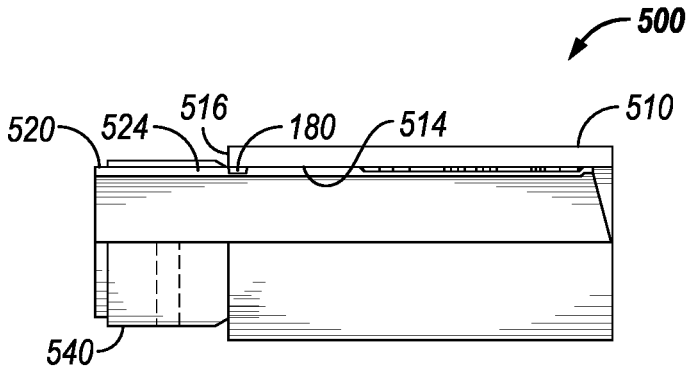
FIG. 14 is another side view of the downhole tubular assembly with the inner tubular member inserted further to displace the cover over the swellable metallic material.

FIG. 14 is another side view of the downhole tubular assembly 500 of FIG. 13 after the inner tubular member 520 has been inserted further into the ID 514 of the outer tubular member 510 to displace the cover 540. The annular sealing members 526 still seal between the inner tubular member 520 and outer tubular member 510. However, the cover 540 has been urged along the OD 524 to expose the swellable metallic material 180 to activation fluid.

Figure 15:
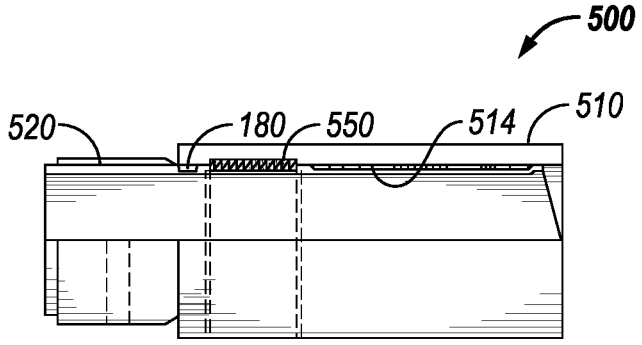
FIG. 15 is another side view of the downhole tubular assembly after the swellable metallic material has swelled in response to exposure to the activation fluid.

FIG. 15 is another side view of the downhole tubular assembly 500 after the swellable metallic material 180 has swelled in response to exposure to the activation fluid. The swollen swellable metallic material 180 is now forcefully engaging the ID 514 of the outer tubular member 510 so as to lock the inner tubular member 520 with the outer tubular member 510. Additional features such as a recess or through hole on the outer tubular member 510, and/or mesh or other porous material can be provided between the tubular members 510, 520 to increase the locking engagement therebetween.

An additional retention device 550 schematically shown in FIG. 15 may be included whereby the swellable metallic material 180 supplements the retention of the retention device 550. The retention device 550 may comprise any suitable tubular connector, such as a ratchet-latching mechanism (i.e., ratch-latch) generally understood in the art apart from the specific teachings of this disclosure. The inner tubular member 520 and the outer tubular member 510 may comprise corresponding ratchet teeth that initially allow relative movement between the tubular members 510, 520 in one direction (e.g., insertion) but resist movement in the opposite direction. The ratch-latch or other retention device 550 may provide some amount of retention between the tubular members 510, 520, and the swellable metallic material 180 increases the retention (e.g., tensile rating) that may otherwise be provided by the retention device 550 alone. The retention device 550 may also be useful to hold the tubular members 510, 520 in place together while the swellable metallic material 180 is activated.

Accordingly, the present disclosure provides a variety of downhole solutions that rely on use of a swellable metallic material to lock a tubular member in position after the tubular member has moved through its functional movement. The methods, systems, compositions, tools and so forth may include any of the various features disclosed herein, including one or more of the following statements.

Statement 1. A well tool comprising: a tool housing including a through bore defined by an inner wall and a wall cavity in the inner wall; a swellable metallic material positioned in the wall cavity; a tubular member moveable within the through bore of the housing from a first position to a second position to perform a tool function, wherein the tubular member blocks flow to the wall cavity in the first position and opens the wall cavity for exposure of the swellable metallic material to an activation fluid in the second position; and wherein the swellable metallic material is configured to swell into engagement with the tubular member in response to the exposure to the activation fluid to hold the tubular member in the second position.

Statement 2. The well tool of claim 1, further comprising a sealing element carried on an outer diameter (OD) of the tubular member, wherein the sealing element engages the inner wall of the tool housing to sealingly close the wall cavity in the first position.

Statement 3. The well tool of claim 1 or 2, further comprising a flow port through a wall of the tubular member, wherein the flow port is offset from the wall cavity in the first position and in fluid communication with the wall cavity in the second position.

Statement 4. The well tool of claim 3, wherein the swellable metallic material in the wall cavity of the tool housing is expandable into the flow port of the tubular member in response to the exposure to the activation fluid.

Statement 5. The well tool of claim 3 or 4, further comprising a porous material positioned in the flow port, wherein the swellable metallic material in the wall cavity of the tool housing is expandable into pores of the porous material in response to the exposure to the activation fluid.

Statement 6. The well tool of any of claims 1 to 5, further comprising a flow path for the activation fluid between the tubular member and the tool housing, wherein the flow path is closed with the tubular member in the first position and open with the tubular member in the second position.

Statement 7. The well tool of any of claims 1 to 6, wherein the tubular member comprises a first inner sleeve member and second inner sleeve member axially arranged in the through bore of the tool housing, wherein the first inner sleeve member is axially moveable into engagement with the second inner sleeve member.

Statement 8. The well tool of claim 7, further comprising an inner sleeve coupler comprising a coupling member on the first inner sleeve member configured to couple with a coupling member on the second inner sleeve member in response to the first inner sleeve member axially engaging the second inner sleeve member.

Statement 9. The well tool of any of claims 1 to 8, wherein the tubular member is axially moveable from the first position to the second position to block flow to the wall cavity.

Statement 10. The well tool of any of claims 1 to 9, wherein the tubular member is rotatable from the first position to the second position.

Statement 11. The well tool of any of claims 1 to 10, wherein the tubular member comprises a piston sealingly engaged with the inner wall of the tool housing and moveable in response to a hydraulic fluid from the first position to the second position.

Statement 12. The well tool of any of claims 1 to 11, wherein the tubular member is moveable from the first position to the second position using a retrievable tool.

Statement 13. A downhole tubular assembly, comprising: an outer tubular member including a through bore defined by an inner diameter (ID); an inner tubular member comprising an outer diameter (OD) moveable into the ID of the outer tubular member; a swellable metallic material carried on the ID of the outer tubular member or the OD of the inner tubular member; a cover initially covering the swellable metallic material, wherein the cover is opened in response to moving the OD of the inner tubular member into the ID of the outer tubular member to expose the swellable metallic material to an activation fluid; and wherein the swellable metallic material is swellable into locking engagement with the ID of the outer tubular member and the OD of the inner tubular member in response to exposure to the activation fluid to secure the outer tubular member to the inner tubular member.

Statement 14. The downhole tubular assembly of claim 13, wherein the outer tubular member comprises a polished bore receptacle defining the ID.

Statement 15. The downhole tubular assembly of claim 14, further comprising a seal assembly disposed on the OD of the inner tubular member for sealing engagement with the ID of the polished bore receptacle.

Statement 16. The downhole tubular assembly of claim 15, further comprising a ratchet-latching mechanism for securing the outer tubular member to the inner tubular member, wherein the swellable metallic material increases a tensile rating of the ratchet-latching mechanism.

Statement 17. A method, comprising: moving an inner tubular member from a first position to a second position within a bore of an outer tubular member with a swellable metallic material carried on an OD of the inner tubular member or an ID of the outer tubular member; and exposing the swellable metallic material to an activation fluid in the second position, wherein the swellable metallic material swells to secure the inner tubular member within the outer tubular member.

Statement 18. The method of claim 17, further comprising: initially blocking the swellable metallic material from exposure to the activation fluid in the first position and exposing the swellable metallic material to the activation fluid in response to moving the inner tubular member to the second position.

Statement 19. The method of claim 17 or 18, wherein moving the inner tubular member to the second position comprises moving a flow port on the inner tubular member into fluid communication with a wall cavity on the outer tubular member containing the swellable metallic material and exposing the swellable metallic material to the activation fluid through the flow port.

Statement 20. The method of claim 19, wherein the swellable metallic material expands into the flow port in response to exposure to the activation fluid.

To facilitate a better understanding of the present invention, the following examples of certain aspects of some embodiments are given. In no way should the following examples be read to limit, or define, the entire scope of the disclosure.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A well tool comprising:

a tool housing including a through bore defined by an inner wall and a wall cavity in the inner wall;

a swellable metallic material positioned in the wall cavity;

a tubular member moveable within the through bore of the housing from a first position to a second position to perform a tool function, wherein the tubular member blocks flow to the wall cavity in the first position and opens the wall cavity for exposure of the swellable metallic material to an activation fluid in the second position; and wherein the swellable metallic material is configured to swell into engagement with the tubular member in response to the exposure to the activation fluid to hold the tubular member in the second position.

2. The well tool of claim 1, further comprising a sealing element carried on an outer diameter (OD) of the tubular member, wherein the sealing element engages the inner wall of the tool housing to sealingly close the wall cavity in the first position.

3. The well tool of claim 1, further comprising a flow port through a wall of the tubular member, wherein the flow port is offset from the wall cavity in the first position and in fluid communication with the wall cavity in the second position.

4. The well tool of claim 3, wherein the swellable metallic material in the wall cavity of the tool housing is expandable into the flow port of the tubular member in response to the exposure to the activation fluid.

5. The well tool of claim 3, further comprising a porous material positioned in the flow port, wherein the swellable metallic material in the wall cavity of the tool housing is expandable into pores of the porous material in response to the exposure to the activation fluid.

6. The well tool of claim 1, further comprising a flow path for the activation fluid between the tubular member and the tool housing, wherein the flow path is closed with the tubular member in the first position and open with the tubular member in the second position.

7. The well tool of claim 1, wherein the tubular member comprises a first inner sleeve member and second inner sleeve member axially arranged in the through bore of the tool housing, wherein the first inner sleeve member is axially moveable into engagement with the second inner sleeve member.

8. The well tool of claim 7, further comprising an inner sleeve coupler comprising a coupling member on the first inner sleeve member configured to couple with a coupling member on the second inner sleeve member in response to the first inner sleeve member axially engaging the second inner sleeve member.

9. The well tool of claim 1, wherein the tubular member is axially moveable from the first position to the second position to open flow to the wall cavity.

10. The well tool of claim 1, wherein the tubular member is rotatable from the first position to the second position.

11. The well tool of claim 1, wherein the tubular member comprises a piston sealingly engaged with the inner wall of the tool housing and moveable in response to a hydraulic fluid from the first position to the second position.

12. The well tool of claim 1, wherein the tubular member is moveable from the first position to the second position using a retrievable tool.

13. A downhole tubular assembly, comprising:

an outer tubular member including a through bore defined by an inner diameter (ID);

an inner tubular member comprising an outer diameter (OD) moveable into the ID of the outer tubular member;

a swellable metallic material carried on the ID of the outer tubular member or the OD of the inner tubular member;

a cover initially covering the swellable metallic material, wherein the cover is opened in response to moving the OD of the inner tubular member into the ID of the outer tubular member to expose the swellable metallic material to an activation fluid, wherein the swellable metallic material is swellable into locking engagement with the ID of the outer tubular member and the OD of the inner tubular member in response to exposure to the activation fluid to secure the outer tubular member to the inner tubular member, and wherein the outer tubular member comprises a polished bore receptacle defining the ID;

a seal assembly disposed on the OD of the inner tubular member for sealing engagement with the ID of the polished bore receptacle; and a ratchet-latching mechanism for securing the outer tubular member to the inner tubular member, wherein the swellable metallic material increases a tensile rating of the ratchet-latching mechanism.

14. A method, comprising:

moving an inner tubular member from a first position to a second position within a bore of an outer tubular member with a swellable metallic material carried on an OD of the inner tubular member or an ID of the outer tubular member;

exposing the swellable metallic material to an activation fluid in the second position, wherein the swellable metallic material swells to secure the inner tubular member within the outer tubular member; and initially blocking the swellable metallic material from exposure to the activation fluid in the first position and exposing the swellable metallic material to the activation fluid in response to moving the inner tubular member to the second position, wherein moving the inner tubular member to the second position comprises moving a flow port on the inner tubular member into fluid communication with a wall cavity on the outer tubular member containing the swellable metallic material and exposing the swellable metallic material to the activation fluid through the flow port.

15. The method of claim 14, wherein the swellable metallic material expands into the flow port in response to exposure to the activation fluid.

* * * * *